US010006340B2

(12) United States Patent
Gray

(10) Patent No.: US 10,006,340 B2
(45) Date of Patent: Jun. 26, 2018

(54) SUPERCHARGER

(71) Applicant: John Malcolm Gray, Calgary (CA)

(72) Inventor: John Malcolm Gray, Calgary (CA)

( * ) Notice: Subject to any disclaimer, the term of this patent is extended or adjusted under 35 U.S.C. 154(b) by 529 days.

(21) Appl. No.: 14/516,535

(22) Filed: Oct. 16, 2014

(65) Prior Publication Data

US 2015/0167541 A1 Jun. 18, 2015

Related U.S. Application Data

(60) Provisional application No. 61/891,583, filed on Oct. 16, 2013.

(51) Int. Cl.

| | |
|---|---|
| ***F02B 33/36*** | (2006.01) |
| ***F04C 23/00*** | (2006.01) |
| ***F04C 18/08*** | (2006.01) |
| ***F04C 18/16*** | (2006.01) |

(52) U.S. Cl.

CPC ..... *F02B 33/36* (2013.01); *F04C 18/084* (2013.01); *F04C 18/16* (2013.01); *F04C 23/001* (2013.01); *F04C 2210/1005* (2013.01); *F04C 2240/60* (2013.01)

(58) Field of Classification Search

CPC ..... F04C 23/001; F04C 18/16; F04C 18/084; F04C 2240/60; F04C 2210/1005; F04C 2250/201

USPC ..... 418/194, 201.1, 201.3, 202, 9

See application file for complete search history.

(56) References Cited

U.S. PATENT DOCUMENTS

| | | | | | |
|---|---|---|---|---|---|
| 2,804,260 | A * | 8/1957 | Nilsson | F04C 18/16 | 123/204 |
| 2,908,226 | A * | 10/1959 | Rich | B01F 7/082 | 418/194 |
| 3,084,851 | A * | 4/1963 | Schibbye | F04C 18/16 | 418/201.1 |
| 3,910,731 | A * | 10/1975 | Persson | F04C 23/001 | 418/201.1 |
| 4,076,468 | A * | 2/1978 | Persson | F04C 23/001 | 418/201.2 |
| 5,527,168 | A | 6/1996 | Juday | | |
| 6,093,008 | A * | 7/2000 | Kirsten | F04C 18/16 | 418/200 |
| 6,257,854 | B1 * | 7/2001 | Fang | F04C 18/086 | 418/107 |

(Continued)

FOREIGN PATENT DOCUMENTS

| | | | | |
|---|---|---|---|---|
| DE | 835834 C | * | 7/1955 | F04C 2/16 |
| EP | 1111243 A2 | * | 6/2001 | F04C 18/084 |

(Continued)

*Primary Examiner* — Jason T Newton

(57) ABSTRACT

A supercharger comprising a series of parallel rotors disposed within adjacent compartments within the housing of the supercharger. The rotors are designed to physically compress air that is drawn into the system in a gradual, linear manner, rather than in a stepped manner as is common to most conventional superchargers, in order to reduce the amount of energy loss to thermal energy and reduce the stress imparted upon the system via the compression of the air. The rotors comprise a shaft and a helical thread. The diameter of the shaft increases and the pitch of the helical thread decreases from the position of the inlet of the chamber in which the rotor is disposed to the position of the outlet of the chamber in which the rotor is disposed.

14 Claims, 5 Drawing Sheets

(56) References Cited

U.S. PATENT DOCUMENTS

| | | | | |
|---|---|---|---|---|
| 8,256,403 | B2 | 9/2012 | Hansen et al. | |
| 8,282,371 | B2 * | 10/2012 | Hashida | F04C 2/084 418/150 |
| 2006/0222553 | A1 * | 10/2006 | Scholz | F01C 21/02 418/201.1 |
| 2010/0040499 | A1 * | 2/2010 | Anderson | F04C 2/16 418/142 |
| 2010/0296958 | A1 * | 11/2010 | North | F04C 18/084 418/201.3 |
| 2011/0083432 | A1 | 4/2011 | Hansen et al. | |
| 2011/0083647 | A1 | 4/2011 | Hansen et al. | |
| 2011/0204654 | A1 | 8/2011 | Hansen et al. | |

FOREIGN PATENT DOCUMENTS

| | | | | |
|---|---|---|---|---|
| FR | 2684417 | A1 * | 6/1993 | F04C 18/16 |
| GB | 677758 | A * | 8/1952 | F04C 18/16 |
| GB | 696732 | A * | 9/1953 | F04C 2/16 |

* cited by examiner

SUPERCHARGER

CROSS REFERENCE TO RELATED APPLICATION

This application claims the benefit of U.S. Provisional Application No. 61/891,583 filed on Oct. 16, 2013, entitled "Supercharger." The above identified patent application is herein incorporated by reference in its entirety to provide continuity of disclosure.

BACKGROUND OF THE INVENTION

Field of the Invention

The present invention relates to a supercharger for an internal combustion engine to supply air thereto. More specifically, the present invention relates to a supercharger that is adapted to linearly compress the volume of air supplied to the internal combustion engine, thereby minimizing the loss of energy in the form of thermal energy.

Conventional aspirated engines are limited in work output by the amount of air that they are able to intake during each combustion cycle, rather than the amount of fuel that is available for each intake cycle. This creates a physical barrier on the amount of work output by the engine, which is defined by the size-to-power ratio of the engine. However, one can increase the work output of the engine by providing an increased amount of oxygen to the engine per intake cycle. Superchargers compress the air supplied to the intake manifold of an internal combustion engine, which increases the density of the intake air and thus increases the amount of oxygen provided to the internal combustion engine during each intake cycle. The increased amount of oxygen supplied per intake cycle allows the engine to burn more fuel per intake cycle, thereby allowing the engine to output more work as compared to an engine that does not have a supercharger, without increasing the size of the engine.

Description of the Prior Art

Devices have been disclosed in the prior art that relate to superchargers. These include devices that have been patented and published in patent application publications. These devices comprise a variety of different mechanically-driven devices that are adapted to physically compress a volume of intake air and transfer the compressed air intake manifold of an internal combustion engine, such as a twin-screw design. The following is a list of devices deemed most relevant to the present disclosure, which are herein described for the purposes of highlighting and differentiating the unique aspects of the present invention, and further highlighting the drawbacks existing in the prior art.

Conventional twin-screw superchargers trap and then transfer a fixed volume of trapped air from atmospheric pressure to a high pressure environment. These devices have a stepped progression between the low pressure environment, i.e. atmospheric pressure, and the high pressure environment and then from the high pressure environment to a negative pressure environment as the trapped air is compressed and then transmitted to the air intake manifold of the internal combustion engine. This high impact, stepped compression between the various states of the supercharger requires more energy input, dissipates a percentage of the energy as undesirable thermal energy that is then imparted to the system, and creates mechanical stress on the system. Therefore, there is a need in the prior art for a supercharger that utilizes gradual, linear compression of the volume of intake air, thereby requiring less energy input to drive the mechanical components of the system, minimizing the amount of energy that is dissipated as thermal energy, and imparting less mechanical stress on the system as compared to a conventional twin-screw supercharger design.

The present invention substantially diverges in design elements from the prior art and consequently it is clear that there is a need in the art for an improvement to existing supercharger devices. In this regard the instant invention substantially fulfills these needs.

SUMMARY OF THE INVENTION

In view of the foregoing disadvantages inherent in the known types of superchargers now present in the prior art, the present invention provides a new supercharger wherein the same can be utilized for providing convenience for the user when seeking to increase the work output of their internal combustion engine.

It is therefore an object of the present invention to provide a new and improved supercharger that has all of the advantages of the prior art and none of the disadvantages.

It is another object of the present invention to provide a supercharger that utilizes a mechanical means for linearly compressing the volume of intake air.

Another object of the present invention is to provide a supercharger that requires less input energy, imparts less thermal energy to the system, and imparts less mechanical stress on the system as compared to a conventional twin-screw supercharger design.

Yet another object of the present invention is to provide a supercharger that may be provided in a number of different designs comprising two or more rotors.

Yet another object of the present invention is to provide a supercharger that comprises a progressively reducing internal cavity volume that gradually compresses air flowing therethrough, spreading the stress imparted on the system from the compression of the intake air over a longer cycle than a conventional twin-screw supercharger.

Still yet another object of the present invention is to provide a supercharger that is adapted to function with a variety of designs of internal combustion engines.

And still yet another object of the present invention is to provide a supercharger that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
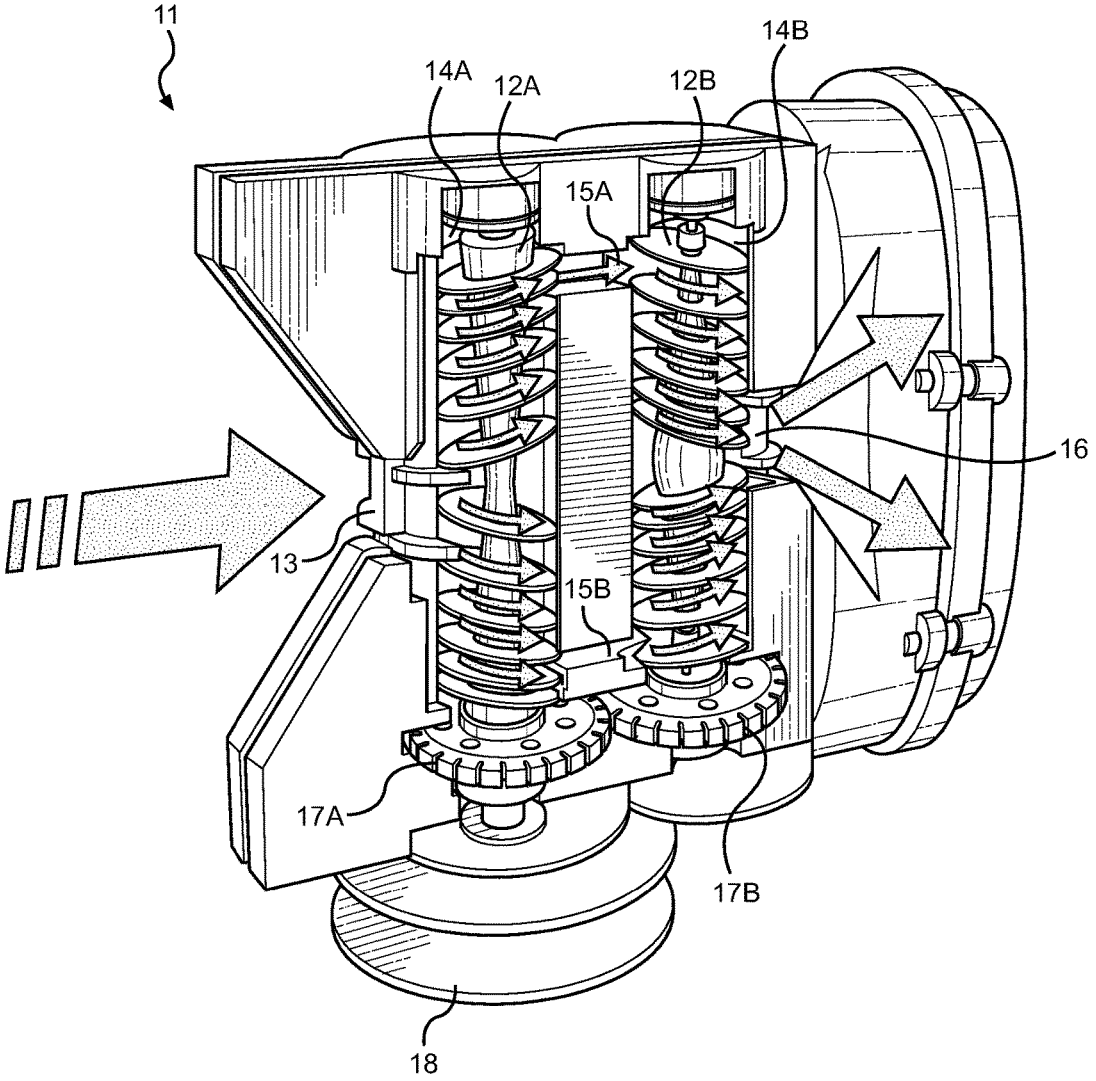
FIG. 1 shows a cross-sectional view of an embodiment of the present supercharger.

Reference is made herein to the attached drawings. Like reference numerals are used throughout the drawings to depict like or similar elements of the supercharger. For the purposes of presenting a brief and clear description of the present invention, the preferred embodiment will be discussed as used for an automobile. The figures are intended for representative purposes only and should not be considered to be limiting in any respect.

The present invention is a supercharger that comprises a series of parallel rotors disposed within adjacent compartments within the housing of the supercharger. The rotors are designed to physically compress air that is drawn into the system in a gradual, linear manner, rather than in a stepped manner as is common to most conventional superchargers, in order to reduce the amount of energy loss to thermal energy and reduce the stress imparted upon the system via the compression of the air. The rotors comprise a shaft and a helical thread. The diameter of the shaft increases and the pitch of the helical thread decreases from the position of the inlet of the chamber in which the rotor is disposed to the position of the outlet of the chamber in which the rotor is disposed. These two factors, in combination, cause a reduction in the annular or circumferential volume of the cavity of the rotors, i.e. the portion of the rotors through which the indrawn air flows. Therefore, as air is drawn into the system, it is progressively squeezed as it is forced into a gradually decreasingly sized volume, physically compressing the air and increasing its density. This compressed, higher-density air is then fed into an air intake manifold, whereupon it improves the performance of the engine because it supplies more oxygen per intake cycle, thereby allowing for more fuel to be burned per intake cycle and improving the work output of the internal combustion engine.

Devices embodying this concept may be provided in a number of different embodiments, including mono-directional or bi-directional rotors that may be provided in a number of different arrangements. As used herein, a mono-directional rotor is defined as a rotor in which the diameter of the shaft increases and the pitch of the helical thread decreases from the first distal end to the second distal end, thereby causing the annular volume of the cavity defined by the helical thread, the shaft, and the interior walls of the compartment in which the rotor is disposed to decrease from the first distal end to the second distal end. The cavity is the space through which the intake air is communicated, thus causing the intake air to be compressed as it is physically forced into an increasingly smaller volume. As used herein, a bi-directional rotor is defined as a rotor in which the diameter of the shaft increases and the pitch of the helical thread decreases from the medial portion of the rotor to both the first distal end and the second distal end, thereby causing the annular volume of the cavity defined by the helical thread, the shaft, and the interior walls of the compartment in which the rotor is disposed to decrease from the middle portion of the rotor to the distal ends. Whereas a mono-directional rotor communicates indrawn air in a single direction, depending upon the handedness of the helical thread, the bi-directional rotor either communicates indrawn air from a single inlet to two separate outlets or from two separate outlets to a single outlet. The two portions of helical thread of the bi-directional rotor have opposite handedness.

Figure 2A:
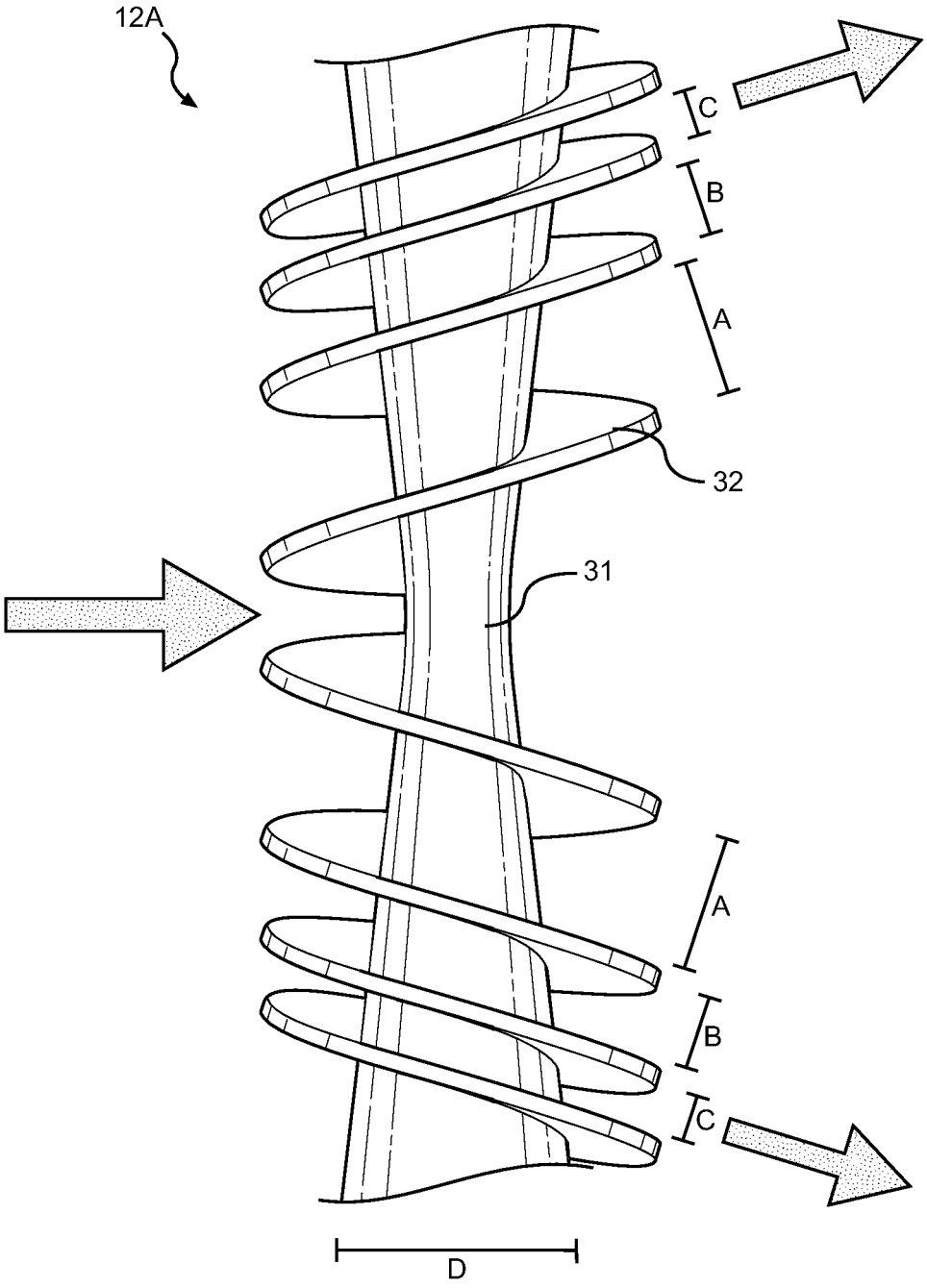
FIG. 2A shows a side elevational view of the first rotor of the embodiment of the present invention depicted in FIG. 1.
Figure 2B:
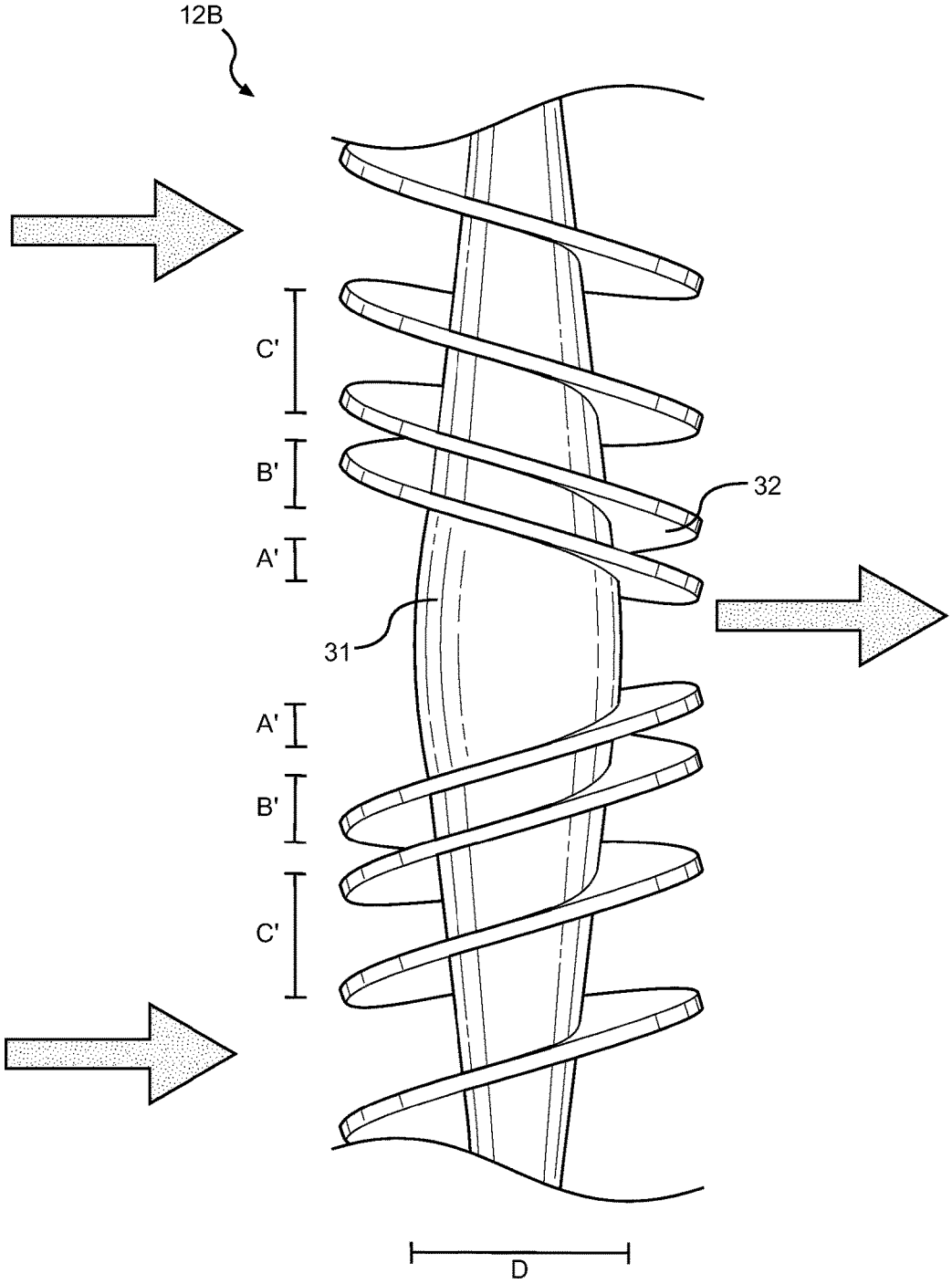
FIG. 2B shows a side elevational view of the second rotor of the embodiment of the present invention depicted in FIG. 1.

Referring now to FIGS. 1, 2A, and 2B, there are shown a cross-sectional view of an embodiment of the present supercharger and side elevational views of the first and second rotors of that embodiment. Superchargers are adapted to draw in air at atmospheric pressure and then mechanically compress the intake air to a pressure above atmospheric pressure, thereby increasing the oxygen density of the air so that more fuel can be burned per intake cycle in order to increase the work output of the internal combustion engine. The present invention comprises a housing 11 having a plurality of chambers 14A, 14B, an inlet 13, an outlet 16, and a plurality of channels 15A, 15B disposed between said chambers 14A, 14B. The chambers 14A, 14B are airtight and prevent any air from being communicated from the housing 11 to the surrounding environment, except via the inlet 13 and the outlet 16. The inlet 13 draws in air from the surrounding environment at atmospheric pressure and the outlet 16 communicates the mechanically compressed air from the interior volume of the housing 11 to the air intake manifold of the internal combustion engine to which the present invention is attached. No claim is made as to the means for connecting and transferring the compressed air from the outlet 16 to the air intake manifold of the engine.

The present invention further comprises a rotor 12A, 12B rotatably disposed in each of said chambers 14A, 14B. The diameter of each rotor 12A, 12B is in close tolerance to the diameter of the interior wall of the corresponding chamber 14A, 14B, preventing air leakage and backflow, ensuring that indrawn air is driven through the cavity. Each rotor 12A, 12B is connected to a corresponding drive mechanism 17A, 17B, which in turn are connected to a power transmission 18, which in turn is connected to the crankshaft of the internal combustion engine via a belt, chain, or other such mechanism. The engine's crankshaft imparts rotational force upon the power transmission 18, which thereby imparts rotational force upon the drive mechanisms 17A, 17B, which thereby impart rotational force upon the rotors 12A, 12B. The rotational movement of the rotors 12A, 12B causes indrawn air to be drawn from the inlet 13, through the internal volume of the chambers 14A, 14B, and to the outlet 16 whereafter it is communicated to the air intake manifold of the internal combustion engine.

Each of the rotors 12A, 12B comprises a shaft 31 portion and a helical thread 32 portion. The shaft 31 has a diameter, D, that is variable along the length of the rotors 12A, 12B. The diameter of the rotors 12A, 12B is smallest at the entry point for the indrawn air of the chamber 14A, 14B in which the rotor 12A, 12B is disposed and largest at the exit point for the indrawn air of the chamber 14A, 14B in which the rotor 12A, 12B is disposed. Although the shafts 31 of the rotors 12A, 12B are variable in size, the overall diameter of the rotors 12A, 12B, i.e. the diameter to which the helical thread 32 extends, remains constant. Because the overall diameter of the rotors 12A, 12B remains constant and the diameter, D, of the shaft 31 increases towards the exit point of the chamber 14A, 14B in which the rotor 12A, 12B is disposed, the volume of the cavity decreases from the entry point to the exit point of the chamber 14A, 14B.

The distance between adjacent crests of the helical thread 32 decreases as the diameter, D, of the shaft 31 increases, i.e. the pitch of the helical thread 32 decreases from the entry point of the chamber 14A, 14B in which the rotor 12A, 12B is disposed to the exit point. Both alone and in combination, the reduction in the pitch of the helical thread 32 and the increase of the diameter, D, of the shaft 31 causes the volume of the cavity through the helical thread 32 to decrease from the entry point to the exit point of the chamber 14A, 14B. The entry and exit point for each particular rotor 14A, 14B depends upon its positioning. For the first rotor 12A, the entry point is the inlet 13. For the last rotor, which is 12B in FIGS. 1 and 12C in FIG. 3, the exit point is the outlet 16. All of the other entry and exit points for the chambers 12A, 12B are the channels 15A, 15B disposed therebetween. The enlargement of the diameter of the shaft 31 and the reduction in the pitch of the helical thread 32 can preferably be expressed in a mathematically linear fashion, thereby creating a smooth, linear compression of the indrawn air that avoids any sudden or stepped reductions in the volume of the air being compressed. This minimizes the amount of thermal energy generated by the compression of the indrawn air and minimizes the amount of stress imparted upon the system.

The rotors 12A, 12B of the present invention are arranged so that air is compressed as it is communicated through the chambers 14A, 14B and the compressed air is then communicated to an adjacent, successive chamber 14A, 14B whereafter it is further compressed. However, the rotors 12A, 12B of the present invention may be provided in a number of different configurations to effectuate that function. The present invention comprises mono-directional rotors having helical thread 32 of either handedness, bi-directional rotors having helical thread 32 of both handedness arranged in different ways, or any combination thereof. Additionally, the present invention comprises any number of rotors 12A, 12B arranged in series. The greater the number of rotors 12A, 12B placed in series, the more the indrawn air is physically compressed by the system.

The depicted embodiment of the present invention comprises a first rotor 12A and a second rotor 12B disposed within a first chamber 14A and a second chamber 14B, respectively. For the first chamber 14A, the entry point is the inlet 13 and the exit points are the first and second channels 15A, 15B. For the second chamber 14B, the entry points are the first and second channels 15A, 15B and the exit point is the outlet 16. The rotors 12A, 12B of the depicted embodiment of the present invention are bi-directional. The first rotor 12A compresses the air drawn through the inlet 13 by driving it to either distal end. That compressed air is then communicated to the second chamber 14B through the first and second channels 15A, 15B, whereafter it proceeds through another stage of physical compression as it is communicated through the second rotor 12B. This compressed air is then communicated to the air intake manifold of the engine to which the present invention is affixed, through the outlet 16.

For the first rotor 12A, because the entry point, i.e. the inlet 13, is adjacent to its medial portion and the exit points, i.e. the channels 15A, 15B, are adjacent to its distal ends, the shaft 31 is tapered at its medial portion and the diameter of the shaft 31 increases towards its distal ends, as seen in FIG. 2A. Furthermore, the pitch of the helical thread 32 decreases from the medial portion to the distal ends. This is demonstrated in diagram fashion in FIG. 2A, wherein the distance between the first crest and the second crest, A, is greater than the distance between the second crest and the third crest, B, which in turn is greater than the distance between the third crest and the fourth crest, C. The increasing diameter of the shaft 31 and the reducing pitch of the helical thread 32 causes the volume of the cavity to reduce, thereby compressing the air drawn therethrough. Furthermore, the helical thread 32 of the first rotor 12A is arranged so that a first portion is right-handed and a second portion is left-handed, thereby driving the indrawn air to the distal ends.

For the second rotor 12B, because the entry points, i.e. the channels 15A, 15B, are adjacent to its distal ends and the exit point, i.e. the outlet 16, is adjacent to the medial portion, the shaft 31 is tapered at its distal ends and the diameter of the shaft 31 increases towards its medial portion, as seen in FIG. 2B. Furthermore, the pitch of the helical thread 32 decreases from the distal ends to the medial portion, which is shown in diagram form in FIG. 2B wherein the distance C' is greater than B', which in turn is greater than A'. Furthermore, the helical thread 32 of the second rotor 12B is arranged so that a second portion is right-handed and a first portion is left-handed, thereby driving the indrawn air to the medial portion.

Figure 3:
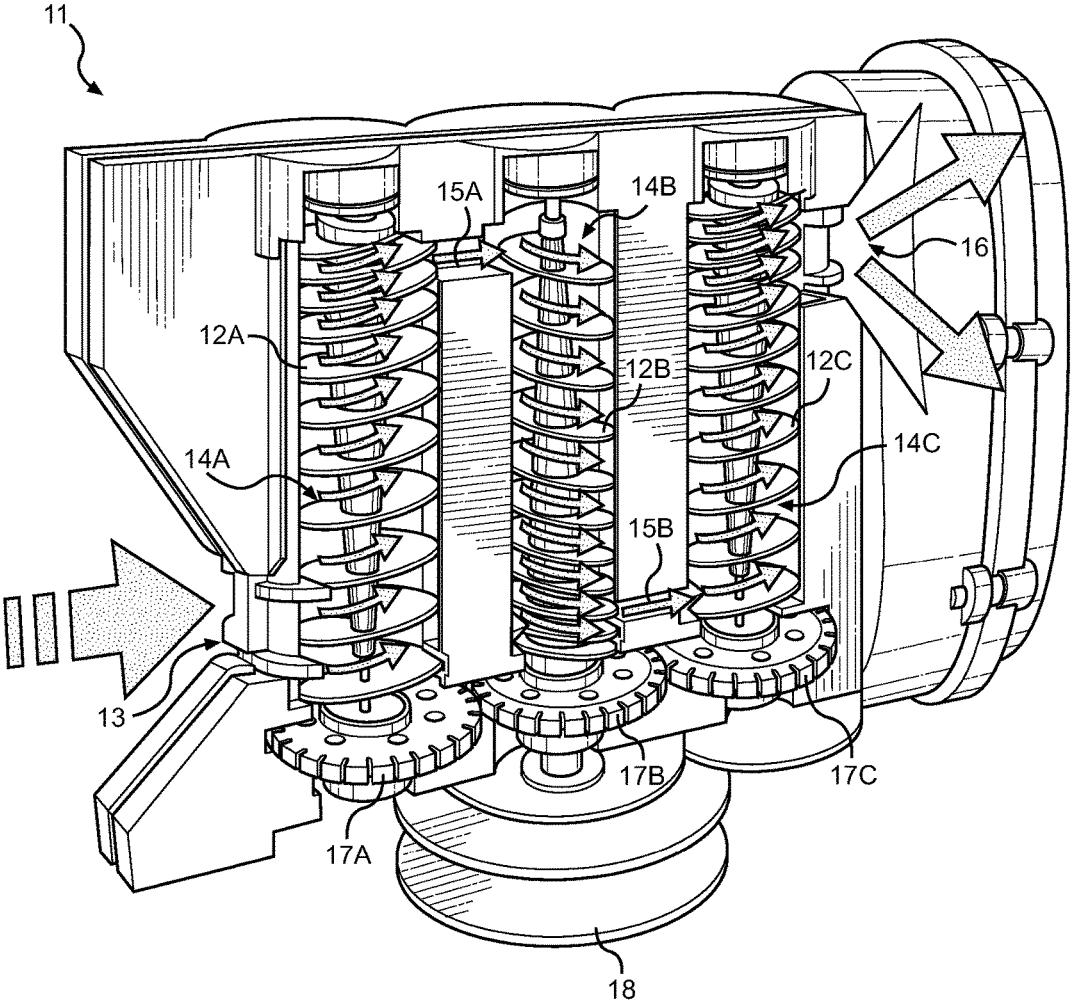
FIG. 3 shows a cross-sectional view of an alternate embodiment of the present invention.

Referring now to FIG. 3, there is shown a cross-sectional view of an alternate embodiment of the present invention. This embodiment of the present invention comprises a first rotor 12A, a second rotor 12B, and a third rotor 12C disposed within a first chamber 14A, a second chamber 14B, and a third chamber 14C, respectively. Each of the rotors 12A, 12B, 12C is in turn driven by a corresponding drive mechanism 17A, 17B, 17C. The diameter of each rotor 12A, 12B, 12C is in close tolerance to the diameter of the interior wall of the corresponding chamber 14A, 14B, 14C, preventing air leakage and backflow, ensuring that indrawn air is driven through the cavity. As opposed to the aforementioned embodiment of the present invention, the depicted embodiment comprises mono-directional rotors 12A, 12B, 12C, as opposed to bi-directional rotors as shown in FIGS. 1, 2A, and 2B.

Although the depicted embodiment of the present invention utilizes mono-directional rotors 12A, 12B, 12C, the principle of the operation of the depicted embodiment is otherwise identical. For each rotor 12A, 12B, 12C, the diameter of the shaft 31 increases and the pitch of the helical thread 32 decreases from the entry point to the exit point of the chamber 14A, 14B, 14C. These two factors cause the volume of the cavity, which is the space through which the indrawn air is driven by the system that is defined by the shaft, the helical thread, and the interior wall of the chamber 14A, 14B, 14C, to reduce from the entry point of the air to the exit point of the air, mechanically compressing the air as it is drawn through the housing 11.

Although depicted as a series of three successive rotors 12A, 12B, 12C, the present invention may be provided in any number of configurations having one or more mono-directional rotors 12A, 12B, 12C. Each additional rotor 12A, 12B, 12C increases the degree to which the air is compressed and therefore the number of rotors 12A, 12B, 12C that may be used in series is limited only by size considerations for the housing 11, the pressure tolerance for the components of the system, and the ability for the crankshaft of the internal combustion engine to drive the rotation of the rotors 12A, 12B, 12C.

Figure 4:
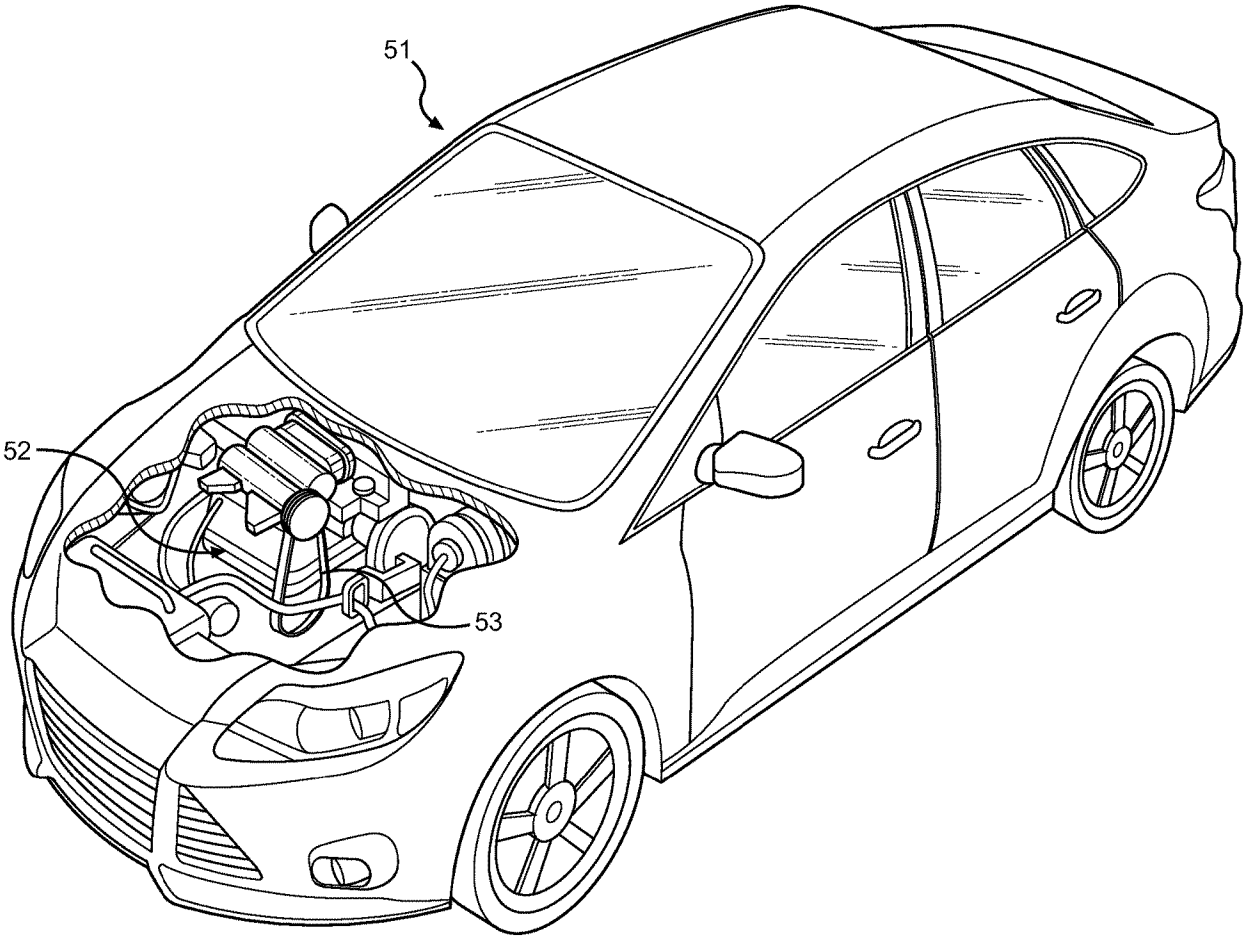
FIG. 4 shows a cutaway view of the present invention affixed to an automobile engine and mechanically driven thereby.

Referring now to FIG. 4, there is shown a cutaway view of the present invention affixed to an automobile engine and mechanically driven thereby. The present invention is installed upon a vehicle's 51 internal combustion engine 52 much the same as a conventional supercharger. The power transmission of the present invention is connected to the crankshaft of the engine 52 via a coupling 53, which comprises a belt, shaft, or any other such device for imparting rotational force from the engine 52 crankshaft to the power transmission of the present invention.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A supercharger for compressing intake air for an internal combustion engine, comprising:

a housing comprising at least one chamber;

said at least one chamber having a constant diameter and comprising an inlet, an outlet, and an internal wall;

one single rotatable rotor disposed within said at least one chamber;

said one single rotatable rotor comprising a shaft having a diameter, a helical thread having a pitch and an overall diameter of the helical thread;

a cavity defined by said internal wall, said helical thread, and said shaft diameter;

wherein the diameter of said shaft increases between said inlet and said outlet of each of said at least one chamber;

wherein the pitch of said helical thread decreases between said inlet and said outlet of each of said at least one chamber;

wherein the overall diameter of said helical thread is constant and remains in close physical proximity to the internal wall of said chamber;

wherein a volume of said cavity decreases as the diameter of said shaft increases and the pitch of said helical thread decreases;

a pulley coupled to a crankshaft of said internal combustion engine for driving the rotation of said one single rotatable rotor.

2. The supercharger of claim 1, wherein said least one chamber comprises a first chamber and an independent second chamber in an adjacent relationship;

wherein said one single rotatable rotor comprises a first rotor disposed within said first chamber; and a second rotor disposed within said second chamber.

3. The supercharger of claim 2, wherein said first rotor comprises a bi-directional rotor comprising a medial portion, a first distal end, and a second distal end;

wherein said outlet of said first chamber comprises a first channel and a second channel;

wherein said inlet of said second chamber comprises said first channel and said second channel;

said second rotor comprises a bi-directional rotor comprising a medial portion, a first distal end, and a second distal end;

said first chamber and said second chamber defining a continuous internal volume in which said first rotor and said second rotor compress said intake air to a pressure above atmospheric pressure.

4. The supercharger of claim 3, wherein said first rotor comprises a right-handed thread.

5. The supercharger of claim 3, wherein said second rotor comprises a left handed thread.

6. The supercharger of claim 3, wherein said inlet of said first chamber is disposed adjacent to said first rotor medial portion.

7. The supercharger of claim 3, wherein said outlet of said second chamber is disposed adjacent to said second rotor medial portion.

8. The supercharger of claim 3, wherein said first rotor and said second rotor are disposed in a parallel relationship.

9. The supercharger of claim 1, wherein said least one chamber comprises a first chamber, a second chamber, and a third chamber;

wherein said one single rotatable rotor comprises a first rotor, a second rotor, and a third rotor;

wherein said first rotor, said second rotor and said third rotor are each disposed within a respective one of said first chamber, said second chamber and said third chamber.

10. The supercharger of claim 9, wherein said first rotor comprises a first mono-directional rotor;

wherein said second rotor comprises a second mono-directional rotor;

wherein said third rotor comprises a third mono-directional rotor;

wherein said outlet of said first chamber is in fluid communication with said inlet of said second chamber;

wherein said outlet of said second chamber is in fluid communication with said inlet of said third chamber;

said first chamber, said second chamber, and said third chamber defining a continuous internal volume in which said first rotor, said second rotor, and said third rotor compress said intake air to a pressure above atmospheric pressure.

11. The supercharger of claim 10, wherein said first rotor comprises one of a right handed thread and a left handed thread.

12. The supercharger of claim 10, wherein said second rotor comprises one of a left handed thread and a right handed thread.

13. The supercharger of claim 10, wherein said third rotor comprises one of a right handed thread and a left handed thread.

14. The supercharger of claim 10, wherein said first rotor, said second rotor, and said third rotor are disposed in a parallel relationship.

* * * * *